United States Patent [19]

Lee

[11] Patent Number: 4,723,472

[45] Date of Patent: Feb. 9, 1988

[54] AMMUNITION CASE NECK SIZING DIE

[76] Inventor: Richard J. Lee, 3146 Kettle Moraine Rd., Hartford, Wis. 53027

[21] Appl. No.: 937,998

[22] Filed: Dec. 4, 1986

[51] Int. Cl.[4] ..... F42B 33/00; F42B 35/02; F42B 33/10

[52] U.S. Cl. ..... 86/24; 29/1.3; 86/23; 86/36; 86/37; 86/41

[58] Field of Search ..... 86/1.1, 23, 24, 36–38, 86/39, 41, 43, 44; 29/1.3, 1.31, 1.32; 102/464

[56] References Cited

U.S. PATENT DOCUMENTS

| | | | |
|---|---|---|---|
| 2,571,272 | 10/1951 | Martin | 86/24 |
| 2,748,648 | 6/1956 | Miller | 86/36 |
| 3,283,643 | 11/1966 | Mittelsteadt | 86/23 |
| 3,580,127 | 8/1968 | Lee | 86/24 |
| 3;705,515 | 12/1972 | Lee | 86/24 |
| 4,133,249 | 1/1979 | Bachhuber et al. | 86/36 |
| 4,385,546 | 5/1983 | Lee | 86/23 |
| 4,593,598 | 6/1986 | Gunder | 86/23 |
| 4,637,291 | 1/1987 | Alexander | 86/24 |

*Primary Examiner*—John F. Terapane
*Assistant Examiner*—Howard J. Locker
*Attorney, Agent, or Firm*—Fuller, Puerner & Hohenfeldt

[57] ABSTRACT

A cylindrical mandrel is inserted through the neck of an ammunition case coaxially with the body of the case after which a collet is driven axially onto the neck to form the inside diameter of the neck to the outside diameter of the mandrel without changing the diameter of the case body. In another embodiment an annular bushing of elastomeric material is confined in a space around the neck and the bushing is compressed axially to cause it to bulge radially inwardly so as to apply a force for forming the neck to the mandrel.

7 Claims, 4 Drawing Figures

AMMUNITION CASE NECK SIZING DIE

BACKGROUND OF THE INVENTION

The invention disclosed herein is a die for accurately sizing the bullet receiving neck of a pistol or rifle ammunition case and for aligning the neck coaxial with the body of the case.

The most widely used method of reloading ammunition cases involves sizing the entire case to the dimensions it had when it was originally manufactured. This is intended to assure that reclaimed ammunition cases will be completely interchangeable between any gun chamber made to standard dimensions. An accurate fit of a reclaimed case in a gun chamber is frequently more important than interchangeability to competitive shooters because they will be using a single gun in competition. Skilled marksmen have long known the most accurate ammunition case is reloaded by sizing only the neck of the case to hold the bullet. This leaves the rest of the cartridge "fire-formed" to fit perfectly in the chamber of the particular gun in which it was formed. Accurate sizing is usually done by pushing the case into a die which sizes the neck smaller than desired without affecting the body of the case. Then an expander is either pulled or pushed through the neck of the case to leave the neck about 0.001" smaller than the bullet to obtain a press fit.

The reason for undersizing the neck and then expanding it to the correct size is to compensate for cartridge case thickness variations. If every case had exactly the same wall thickness, it would be possible to simply push the case into a die of the correct size for a perfect fit. However, cases vary because of manufacturing tolerances and the forces generated by repeated use.

A problem with prior art sizing methods is that concentricity and axial misalignment between the neck and body of the case can be caused by using existing standard dies. The centerline of the neck axis to the centerline of the case head can frequently be offset by as much as 0.025". Thus, the bullet can be not only seated off center in the case neck but its axis can also be at an angle with the axis of the body of the case. The lack of concentricity and presence of axial misalignment both affect shooting accuracy adversely.

A further problem of undersizing the neck and then expanding it up to proper size is that it shortens the case life caused by the extra working of the brass out of which the case is made.

U.S. Pat. No. 4,133,249, issued Jan. 9, 1979, discloses an ammunition case reloading press in which one approach to sizing the neck of the case and obtaining concentricity and alignment between the neck and body of rifle and pistol ammunition cases is demonstrated. The patent also provides for resizing the metal ferrule on shotgun shells. The resizer devices are built into the press and a substantial amount of mechanism is dedicated to doing the neck and body resizing of a case. The approach is to mount a case in such manner that it can be disposed within a collet. The collet is basically conventional in that it is composed of a plurality of fingers arranged in a circle with space between them so they can be driven radially inwardly to press against the outside of the case neck and body while a cylindrical mandrel is positioned inside of the case. The collet fingers are connected at one end and they are springy so that the collet tends to spring open to allow insertion of an ammunition case. The collet is arranged for being drawn into a cylinder. As the collet fingers are drawn into the cylinder, the cylinder wall presses the collet fingers radially inward to squeeze the wall of the case body against the mandrel. The mandrel also has a tip which drives the spent primer out of the case. The problem with this arrangement is that the collet type sizer has to be designed for fitting in only one press so all of the advantages of sizing with traditional standard dies that will fit into the presses of practically all manufacturers, are lost.

SUMMARY OF THE INVENTION

The new neck sizing die described hereafter overcomes all of the problems mentioned above without loss of convenience or sizing speed.

Embodiments of the new sizing die described herein features placing a cylindrical mandrel in the neck and squeezing the neck of the cartridge substantially uniformly radially inwardly with a wedged metallic collet or an elastomeric ring which is compressed axially to develop a radially inwardly compressive force. The mandrel has an outside diameter which is usually about one or two thousands of an inch under the bullet diameter. Preferably the mandrel is long enough to pass through the entire length of the case such that a small tip on the mandrel will fit into the flash hole in the head of the case which connects to the pocket into which a primer will be inserted after the case is properly sized and before it is filled with gun powder and before it has the bullet inserted. An important feature of the new design is that the collet type resizer is now incorporated in a body that fits into a resizing press like other standard dies so the resizer can be used in case reloading presses of the majority of manufacturers who have adopted certain standards for presses. Another very important feature of the new die is that it resizes only the neck of the case and leaves the body remain in its fire-formed shape although the neck is made concentric to the body.

A more detailed description of embodiments of the new sizing die will now be set forth in reference to the drawing.

DESCRIPTION OF A PREFERRED EMBODIMENT

Figure 1:
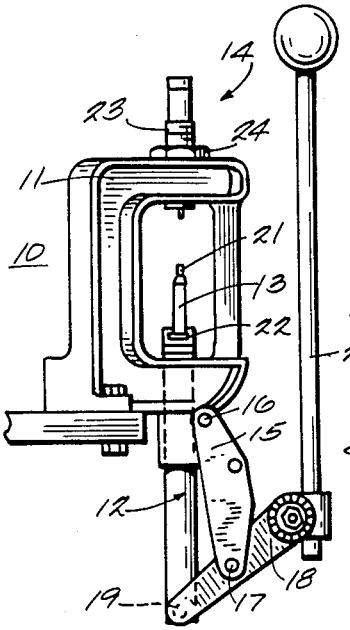
FIG. 1 is a side elevation of a cartridge case reloading press which is shown in readiness for pressing the case into the new neck sizing die which is mounted in the press.

FIG. 1 shows a well known type of ammunition case reloading press 10 comprised of a frame 11 through which a ram 12 carrying an ammunition case 13 drives the case into the new die 14 which is mounted to the press. The operating mechanism in the illustrative press comprises a link 15 which is pivotally mounted at 16 to the frame and at 17 to a lever 18. The lever is pivotally connected at 19 to ram 12. Swinging the operating handle 20 clockwise drives ram 12 upwardly so as to push ammunition case 13 into new neck sizing die 14 to shape the neck 21. The head of the cartridge case is engaged in a standard case holder 22. The die has a thread 23 which allows it to be screwed into press frame 11. A lock nut 24 is tightened against the frame to keep the die at the elevation at which the case properly stops when it is driven by the ram into the die.

Figure 3:
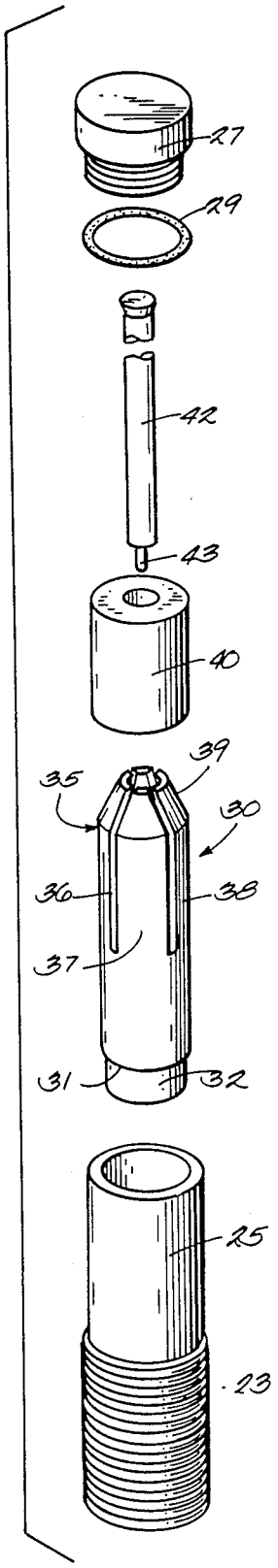
FIG. 3 is an exploded view of the neck sizing die depicted in FIG. 2.
Figure 2:
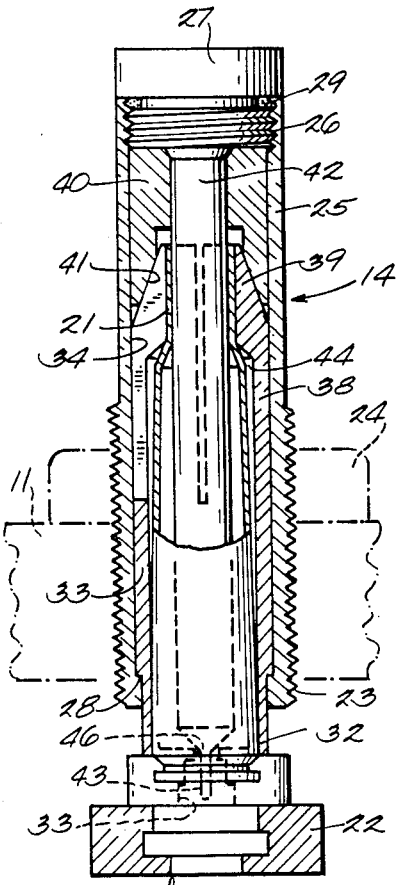
FIG. 2 is a vertical section of one embodiment of the new ammunition case neck sizing die.
Figure 4:
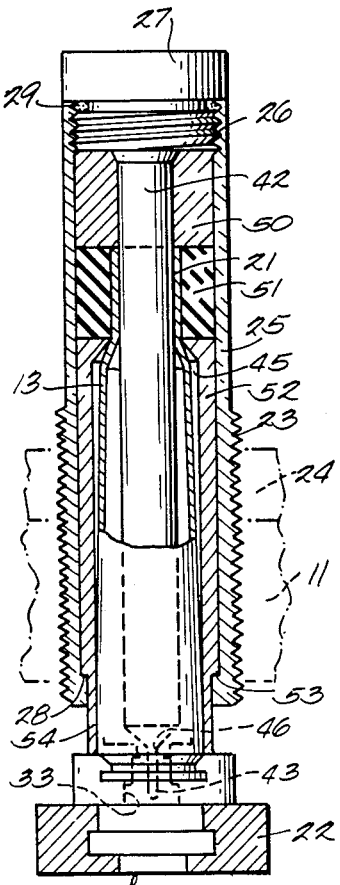
FIG. 4 is an alternative embodiment of the new sizing die.

Referring to FIGS. 2 and 3, the new sizing die 14 is comprised of a cylindrical tubular body 25 which has the external thread 23 on it for screwing the die into an ammunition case reloading press that has a corresponding standard threaded and sized hole. The upper end of the die body in FIG. 2 has an internal thread 26 into which a metal assembly retaining plug 27 having an external thread is screwed. A rubber o-ring 29 is installed between cap 27 and die housing 25 to frictionally grip the cap so it does not turn out inadvertently. Inside of the lower end of the die housing there is a radially inwardly extending shoulder 28. A collet, generally designated by the numeral 30 in FIG. 3 is supported in housing 25 on internal shoulder 28. As shown in FIG. 3, collet 30 has a radially outwardly extending shoulder 31 which allows for the collet to be supported as shown in FIGS. 2 and 4, on internal shoulder 28 of the die housing 25. A cylindrical extension 32 on collet 30 extends through the bottom of die housing 25 and abuts against the top of a standard cartridge holder 22. The collet 30 is cylindrical and its outside diameter is such that it makes a snug fit within the inner bore 34 of die housing 25. Collet 30 is similar to known collets in that it has a cylindrical part 35 which has two diametrical slots 36 which are 90° apart so as to divide the collet into four segments or fingers such as those marked 37 and 38. These fingers are sufficiently thin to permit them to flex radially inwardly when subjected to a uniform radially inwardly directed force.

As can be seen readily in FIG. 3, the upper ends of the collet segments are formed so as to define a cone 39. The inside of collet housing 25 is provided near its upper end with a fixed jaw or wedging anvil in the form of a plug 40 that contains an internal conical counterbore 41 as best seen in FIG. 2. When cartridge case 13 is rammed into the die, the beveled or conical ends 39 of the collet fingers are wedged inwardly by reaction against internal conical bore 41 in anvil 40.

The amount of inward depressing of the neck 21 of the cartridge case is limited by a cylindrical mandrel 42. This mandrel has, as mentioned earlier, a diameter slightly less than the diameter of the bullet that is to be inserted in the case neck. The tolerance takes into account the fact that when the case is withdrawn from the die after the neck is squeezed radially inwardly, there will be a little bit of spring back or inherent expansion of the neck opening due to the metal being worked below its elastic limit. The inside diameter of the case neck may be, by way of example and not limitation, about 0.001 or 0.002 of an inch under the outside of diameter of the bullet for most common size cases.

The lower end of mandrel 42 has a reduced diameter tip 43 which, as can be seen in FIG. 2, passes snugly through the small flash hole 46 that connects to the primer pocket 33 in the cartridge case. Tip 43 is thus compelled to be centered with the case head and because the upper end of mandrel 42 is compelled to be concentric with the interior of die housing 25, the neck 21 of the case is necessarily compelled to be coaxial with the axis of the body of the case. Hence, the axes of the case 13 body and its neck cannot be askew. Note in FIG. 2 that a space 44 is allowed to remain between the flexing fingers 38 of the collet and the periphery of the ammunition case 13 so that the case body will remain at its fire-formed dimensions while its neck is being sized.

To use the die, it is screwed into a press frame or the like as shown in FIG. 1. The ram 12 of the press is retracted and the ammunition case 13 is placed on the standard cartridge holder 22. The manual operating lever 20 on the press is then manipulated so the ram 12 drives the cartridge 13 into the die. The force applied to the lower cylindrical end 32 of the collet drives its conical ends 39 into wedging relation with the internal conical counterbore 41 of anvil 40, thus squeezing the fingers of the collet radially inward into compressive relation against the outside of case neck 21 which is occupied by mandrel 42. After this single stroke is executed to size the neck 21 of the case 13, the ram 12 is retracted and the case is removed from the holder.

The concept of squeezing the neck of an ammunition case against a mandrel to assure concentricity and axial alignment of the neck with the body of the case can also be implemented with the FIGURE 4 embodiment. In this figure, parts that are similar to the FIGS. 2 and 3 embodiment are given the same reference numerals. Thus, the FIG. 4 embodiment of the die comprises a cylindrical housing 25 having an internal bore terminating at its lower end in a radially inwardly extending shoulder 28. The die has the external thread 23 for screwing it into a part of an ammunition reloading press 11 and holding it with a lock nut 24. There is an internal thread 26 in the upper end of the die housing which is closed by a cap 27 having an external thread that mates with the internal thread 26. An o-ring 29 frictionally grips cap 27. The same mandrel 42 can be used for the same size ammunition case 13 as was used in the previously discussed embodiment. The mandrel again has a tip 43 at its lower end for extending through the primer cap flash hole in the head of the cartridge. The case in FIG. 4 is engaged in a standard case holder 22.

The upper end of the housing 25 in FIG. 4 is occupied by a metal ring 50 and it has a bore through which mandrel 42 passes snugly. The ring makes a close fit in housing 25. The upper end of mandrel 42 is, thus, compelled to be concentric with the bore in housing 25. Under ring 50 there is a bushing 51 composed of elastomeric material that is comparable in purpose to a hydraulic fluid which can be compressed axially to cause uniform radial expansion for driving the neck 21 of the ammunition case into compressive relationship with the mandrel 42. Fairly high durometer rubber and polyurethane are but two examples of suitable materials. For compressing elastomeric bushing 51, a sleeve 52 which serves the purpose of a piston is provided inside of die housing 25. Piston 52 has a shoulder 53 at its lower end which allows it to rest on internal housing shoulder 28 that precludes the sleeve from sliding out of the housing. The sleeve has an extension 54 which rests on the top of die holder 22 so that when the die holder is forced upwardly under the influence of the reloading press ram, the upper end of the sleeve 52 will compress against the confined elastomeric bushing 51. The bushing 51 is confined about case neck 21 and between ring 50 and the upper end of piston-like sleeve 52. The flow of the elastomeric bushing is such as to develop radial and axial forces as would be the case if the bushing were comprised of confined hydraulic fluid. The compressive force of the bushing 51 presses the case neck 21 uniformly against cylindrical mandrel 52 while the tip 43 of the mandrel is engaged in the small flash hole 46 which leads from the primer cap pocket 43 in the head of the ammunition case. Thus, the concept of implementing a die body having standard external mounting threads for pressing the neck of a case with a uniform force against a concentric mandrel while the mandrel is maintained in coaxial alignment with all parts of the case by reason of its tip engaging in the primer cap hole of the cartridge is also accomplished in the FIG. 4 embodiment of the new die. The FIG. 4 embodiment is most suitable for annealed cases. In both of the described embodiments a ram applies an axial force which results in development of a uniform radial force that is transmitted to the case neck for squeezing the neck against a dimension defining mandrel.

I claim:

1. A die for sizing an ammunition case comprising a body, a neck at one end of the body for receiving a bullet and a head at the opposite end of the body in which there is a primer pocket and a central flash hole connecting the pocket to the interior of the body, said die comprising:

a cylndrical element having a standard external thread for screwing into the standard thread of a reloading press and having an axial bore for receiving coaxially said case whose neck is to be sized and aligned concentric to said case body and head, a cylindrical mandrel having an outside diameter substantially equal to the desired inside diameter of said neck, said mandrel being arranged for extending axially through said neck when said case is in said bore, said mandrel having a reduced diameter cylindrical tip extending axially for registering in the primer flash hole in said case when said mandrel extends through said neck and said body of the case, radially inwardly flexing squeezing means in said bore of said cylindrical element arranged to surround said neck and responsive to an applied axial driving force causing relative axial movement between said case and said cylindrical element by squeezing only said neck of the case radially inwardly onto said mandrel to substantially conform the inside size of said neck to the size of said mandrel, and, a pin on an end of the mandrel for being in said flash hole when said neck is being squeezed so said neck and case body are compelled to become concentric.

2. A die for sizing an ammunition case comprising a body, a neck at one end of the body for receiving a bullet and a head at the opposite end of the body in which there is a primer pocket and a central flash hole connecting the pocket to the interior of the body, said die comprising:

a cylindrical element having a standard external thread for screwing into a standard thread of a reloading press and having an axial bore for receiving said case coaxially whose neck is to be sized and aligned concentric to said case body and head, a cylindrical mandrel having an outside diameter substantially equal to the desired inside diameter of said neck, said mandrel being arranged for extending through said neck coaxially to said bore, collet means comprised of a tubular body and a plurality of fingers formed on said tubular body for extending axially in said bore for flexing radially inwardly and outwardly, said fingers being arranged in a circle with space between said fingers so that a case can be inserted within said circle, said fingers being externally tapered at corresponding ends and being disposed circumjacent said neck of the case in said cylindrical element, a member located in said bore of said cylindrical element and having an internally tapered hole coaxial with said bore in which hole said externally tapered finger ends register such that when an axial force is applied to said fingers said tapered ends wedge in said tapered hole to cause radial inward deflection of said fingers for squeezing the neck of said case on said mandrel without squeezing the body of the case, said mandrel having a reduced diameter axially extending tip for registering in the primer flash hole in said case when said mandrel extends through the neck and said body of the case to force said neck and body into being aligned and concentric when said neck is squeezed.

3. The device according to claim 2 wherein a free space remains between said fingers and the body of said case when said fingers squeeze send neck so the size of said case body is not attached.

4. A die for sizing the neck of an ammunition case comprising a body, an neck at one end of said body for receiving a bullet and a head at the opposite end of the body in which there is a primer pocket having a central flash hole connecting the pocket to the interior of the body, said die comprising:

a cylindrical element having a standard external thread for scrwing into a standard thread of a reloading press and having a bore that is closed at one end, a cylindrical mandrel fixed coaxially in said bore and extending away from said closed end toward the other end of the bore, said mandrel having an outside diameter substantially equal to the desired inside diameter of the neck and having a tip for extending into said central flash hole, a member in said bore having a tapered counterbore diverging away from said closed end toward said other end, collet means in said bore comprised of a tubular body having a portion extending out of said other end of the bore and an axially opposite portion having radial slots defining a plurality of radially inwardly deflectable fingers projecting axially from said tubular body for admitting the neck and body of said ammunition case between them, the ends of said fingers being tapered externally and complementarily to said tapered counterbore and extending toward said counterbore, said neck being between said ends of the fingers and said mandrel when a case is inserted in said cylindrical element, applying an axial force on said portion of said tubular body of the collet means that extends from said cylindrical element when said case is pressed on said mandrel with said neck disposed between said ends of said fingers causing said tapered ends of the fingers to wedge into said tapered counterbore and be squeezed radially inwardly against said neck so as to conform the size of the inside of said neck with the size of said mandrel, and at the same time forcing said neck to be concentric over its entire length to said flash hole and said case body, said fingers being shaped such that only said ends thereof contact said neck of the case for a free space to remain between said fingers and case body when said neck is being squeezed so the size of said case body is not altered.

5. A die for sizing the neck of an ammunition case comprising a body and a neck for receiving a bullet, said die including:

a tubular element having an external thread and an axial bore that is closed at one end, a cylindrical mandrel arranged coaxially in said bore and extending away from said closed end toward the other end of said bore, generally cylindrical sleeve means arranged coaxially in said bore with a portion of said sleeve means extending outwardly of said other end of the bore, a bushing comprised of elastomeric material disposed in said bore concentrically to said mandrel and to said bore and proximate to said closed end, said bushing having a central hole whose diameter is sufficiently larger than the diameter of said mandrel to permit said neck of the case to enter between said mandrel and said bushing when said bushing is uncompressed and said case is pushed axially into said tubular element, applying an axial force on said outwardly extending portion of said sleeve means causing axial compression and radial inward expansion of said bushing to force said neck to acquire an inside diameter substantially equal to the outside diameter of said mandrel.

6. The device according to claim 5 wherein said mandrel has a reduced diameter tip at an end remote from the closed end of said bore for entering the centrally located primer flash hole in said case to maintain the body and neck of said case coaxial with said mandrel.

7. The device according to any one of claims 5 or 6 wherein a free space exists between the body of the case and said sleeve so said body size is not altered when said device is occupied by said case.

* * * * *

UNITED STATES PATENT AND TRADEMARK OFFICE

CERTIFICATE OF CORRECTION

PATENT NO. : 4,723,472

DATED : February 9, 1988

INVENTOR(S) : Richard J. Lee

It is certified that error appears in the above—identified patent and that said Letters Patent is hereby corrected as shown below:

| | |
|---|---|
| Column 6, Line 21 | Delete "send" and substitute therefor ---said--- |
| Column 6, Line 22 | Delete "attached" and substitute therefor ---altered--- |
| Column 6, Line 24 | Delete "an" and substitute therefor ---a--- |
| Column 6, Line 30 | Delete "scrwing" and substitute therefor ---screwing--- |

Signed and Sealed this

Eighteenth Day of October, 1988

*Attest:*

DONALD J. QUIGG

*Attesting Officer*

*Commissioner of Patents and Trademarks*